United States Patent [19]

Yalof

[11] 3,977,420

[45] Aug. 31, 1976

[54] RETRACTABLE COMB

[76] Inventor: Stanley A. Yalof, 7605 Convoy Court, San Diego, Calif. 92111

[22] Filed: Sept. 15, 1975

[21] Appl. No.: 613,105

[52] U.S. Cl. ..... 132/11 R
[51] Int. Cl.[2] ..... A45D 1/00
[58] Field of Search ..... 132/11 R, 118, 136–137, 132/143

[56] References Cited

UNITED STATES PATENTS

| | | | |
|---|---|---|---|
| 597,121 | 1/1898 | Norton | 132/143 |
| 1,643,168 | 9/1927 | Nevotti | 132/118 |
| 2,559,004 | 7/1951 | Brown et al. | 132/118 |
| 2,618,276 | 11/1952 | Hamparson et al. | 132/137 |
| 3,424,174 | 1/1969 | Battaglia | 132/11 R |

*Primary Examiner*—G.E. McNeill

[57] ABSTRACT

A retractable comb having metallic tines or teeth, each of which are attached to a separate pinion gear and each pinion gear being rotatably carried by a sheath having a slot in the top portion thereof and being coplanar with the tines. A rack slidably carried by the sheath and having gear teeth in engagement with the pinion gears for rotating the pinion gears into an exposed position with the tines extending vertically out of the sheath and through the slot in the sheath and rotating the pinion gears in an opposite direction whereby the tines are rotated to a retracted position.

3 Claims, 5 Drawing Figures

RETRACTABLE COMB

BACKGROUND OF THE INVENTION

Combs with long tines have been used for decades for currying long-haired animal furs, as in horses and dogs, and for recent use in the combing of human hair, particularly for the Afro hairstyles. The tines of these combs are typically fabricated of metal and range from 2½ to 4'' in length. Fabrication is usually implemented by imbedding a row of metallic tines within a holder of wood, plastic or metal. These combs are difficult to carry within pockets and purses, tending to become entangled as well as puncturing and tearing contacting materials.

BRIEF DESCRIPTION OF THE INVENTION

According to the invention, a retractable comb is provided having tines or teeth fabricated of metal and typically 4'' in length. Each tine is fixedly attached to a different pinion gear which is rotatably carried by a housing or outside sheath. A rack having teeth in engagement with the teeth of the pinion gears is slidably carried by the sheath for rotation of the pinion gears for erection of the tines in one extreme position, and retraction of the tines in another extreme position. Hence, during periods of non-use and storage, the tines are retracted for convenient storage in a pocket or purse, etc., and when in use the tines are erected.

An object of the present invention is the provision of a comb having retractable tines.

Another object of the invention is the provision of a retractable comb which is inexpensive to manufacture and extremely convenient in use.

Other objects and many of the attendant advantages of the present invention will be readily appreciated as the same becomes better understood by reference to the following detailed description, when considered in connection with the accompanying drawings in which like reference numerals designate like parts throughout the Figures thereof and wherein.

DETAILED DESCRIPTION OF THE DRAWING

Figure 1:
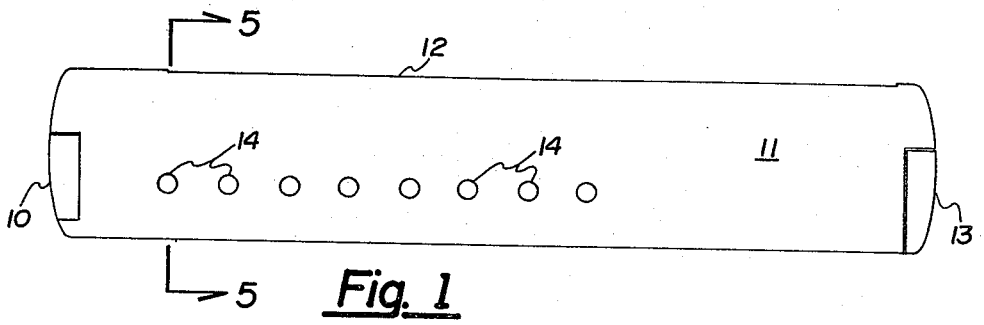
FIG. 1 is a side elevational view of the preferred embodiment of the invention in a tine retracted position.

Referring to FIG. 1, an outside sheath or housing 11 has a recessed slot area 12 and slidably carries a rack member 13 which, in the closed position shown, is flush at each end of sheath member 11. Pinion gear axles 14 are rotatably mounted on each side of sheath 11.

Figure 2:
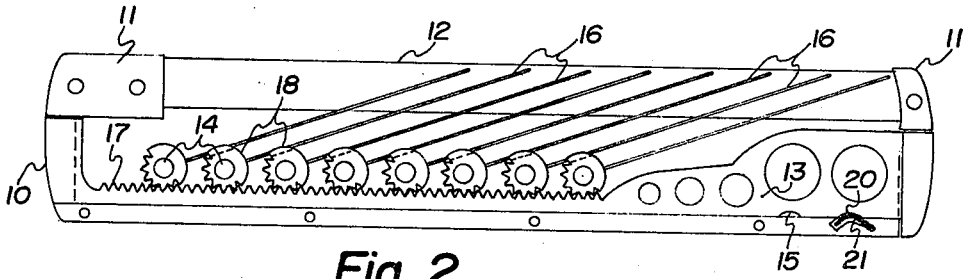
FIG. 2 is a side elevational view of the embodiment of FIG. 1 with portions of the outside sheaths removed.

Referring to FIG. 2, sheath member 11 is shown broken away having a recessed slot portion 12 and tines or teeth 16 with their upper ends disposed therein at an oblique angle. Rack member 13 has teeth 17 which are in engagement with pinion gears 18. Pinion gears 18 are fixedly attached to tines 16. Pinion gears 18 have axles 14 which are rotatably carried by sheath member 11. Rack member 13 has detents 15 and 20 which cooperate with spring latch 12 in each extreme position.

Figure 3:
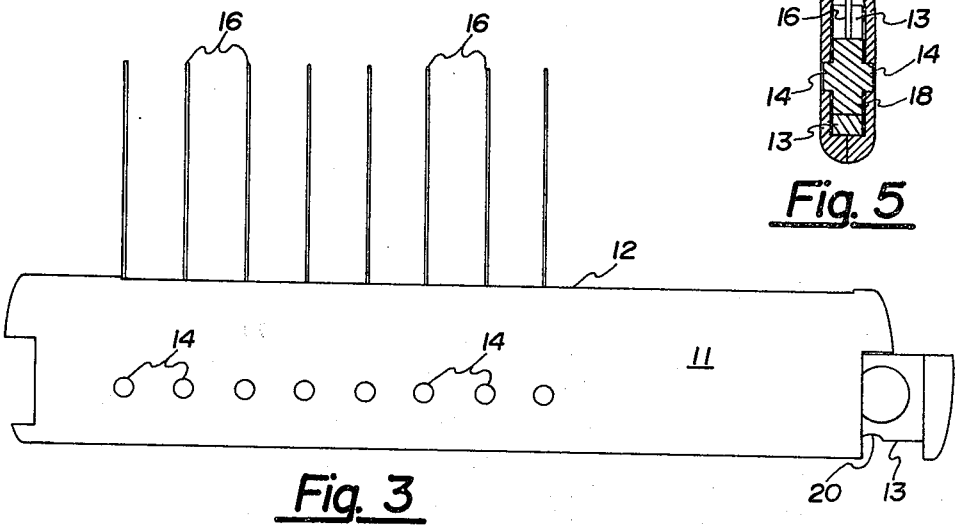
FIG. 3 is a side elevational view of the embodiment of FIG. 1 showing the tines in an erected position.

Referring to FIG. 3, sheath member 11 rotatably carries pinion axles 14 which are fixedly attached to tines 16. In the position shown in FIG. 3, rack member 13 is extended to the right.

Figure 4:
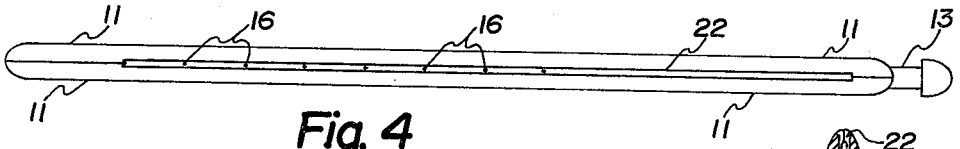
FIG. 4 is a top view of the embodiment of FIG. 3.

Referring to FIG. 4, tines 11 are shown within and protruding from slot 22 in sheath member 11. Rack member 13 is shown extending to the right of sheath member 11.

Figure 5:
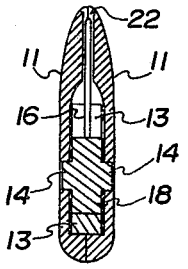
FIG. 5 is a cross sectional view taken along lines 5 — 5 of FIG. 1.

Referring to FIG. 5, sheath member 11 has slot 22 with tine 16 extending therein. Tine 16 is fixedly attached to pinion 18 which has an axle 14 rotatably carried by sheath member 11. Rack member 13 is slidably disposed within and carried by sheath member 11.

OPERATION

Referring back to FIG. 2, it can be seen that with rack member 13 in its extreme left position, pinion gears 18 are rotated in their extreme clockwise position, rotating tines 16 to a retracted position beneath the top recessed edge 12 of sheath member 11. In this position, a spring latch 21 is disposed within detent 20 in rack member 13 latching it in this position. Here, the entire assembly can be conveniently carried in a pocket or purse without tines 16 becoming entangled with any other objects or material.

When it is desired to use the comb, rack member 13 is pushed to the right as shown in FIG. 3 which rotates pinion gears 18 together with tines 16 counterclockwise until detent 15 in rack member 13 is disposed over spring latch 21 and the mechanism is latched in the position shown in FIG. 3.

It should be understood, of course, that the foregoing disclosure relates to only a preferred embodiment of the invention and that it is intended to cover all changes and modifications of the example of the invention herein chosen, for the purposes of the disclosure, which do not constitute departures from the spirit and scope of the invention.

The invention claimed is:

1. A retractable comb comprising:

a sheath member having first and second walls defining a hollow space therebetween, and having a slot in the top portion thereof dimensioned for receiving metallic comb tines;

a plurality of pinion gears rotatably carried between said first and second walls of said sheath member;

a rack member slidably received and carried by said sheath member, said rack member having a plurality of gear teeth engaged with said plurality of pinion gears; and a plurality of tines, each of said plurality of tines being fixedly attached to a different one of said pinion gears.

2. The retractable comb of claim 1 and further including:

latching means in said rack member and said sheath member operable for latching said rack member in first and second extreme relative positions to said sheath member.

3. The retractable comb of claim 2 wherein said latching means comprises:

first and second recesses in one of said rack member and sheath member; and a cooperating spring latch in another of said rack member and sheath member.

* * * * *